US007918515B2

(12) United States Patent
Wang

(10) Patent No.: US 7,918,515 B2
(45) Date of Patent: Apr. 5, 2011

(54) MODULAR SHELVING SYSTEM

(75) Inventor: Chi-Chung Wang, Kaohsiung Hsien (TW)

(73) Assignee: Chi Yu Steel Co., Ltd., Kaohsiung Hsien (TW)

( * ) Notice: Subject to any disclaimer, the term of this patent is extended or adjusted under 35 U.S.C. 154(b) by 267 days.

(21) Appl. No.: 12/287,251

(22) Filed: Oct. 6, 2008

(65) Prior Publication Data

US 2010/0084356 A1 Apr. 8, 2010

(51) Int. Cl.
*A47B 87/00* (2006.01)

(52) U.S. Cl. ..... 312/108; 312/265.5; 211/194

(58) Field of Classification Search ..... 211/188, 211/194, 195, 85, 186, 189; 248/150; 206/503; 220/4.26; 312/107, 108, 111, 265.5; 108/193, 108/147.16; 446/105

See application file for complete search history.

(56) References Cited

U.S. PATENT DOCUMENTS

| | | | | | |
|---|---|---|---|---|---|
| 1,076,116 | A | * | 10/1913 | Lee | 312/111 |
| 1,281,856 | A | * | 10/1918 | Shaw | 446/112 |
| 1,492,560 | A | * | 5/1924 | Fisher | 446/105 |
| 3,229,334 | A | * | 1/1966 | Thome | 403/173 |
| 3,401,814 | A | * | 9/1968 | Chiswell et al. | 220/4.33 |
| 3,685,465 | A | * | 8/1972 | Haumer | 108/60 |
| 3,836,218 | A | * | 9/1974 | Hallal | 312/111 |
| 3,841,726 | A | * | 10/1974 | Andros et al. | 312/111 |
| 4,886,326 | A | * | 12/1989 | Kuzyk | 312/257.1 |
| 5,466,057 | A | * | 11/1995 | Blankenburg | 312/108 |
| 5,525,005 | A | * | 6/1996 | Chen | 403/374.4 |
| 5,893,617 | A | * | 4/1999 | Lee | 312/263 |
| 6,645,032 | B2 | * | 11/2003 | Barringer et al. | 446/108 |
| 2004/0222722 | A1 | * | 11/2004 | Yang | 312/265.5 |
| 2005/0200250 | A1 | * | 9/2005 | Zillmann et al. | 312/265.5 |
| 2007/0132345 | A1 | * | 6/2007 | Lai | 312/265.4 |

FOREIGN PATENT DOCUMENTS

| | | | | |
|---|---|---|---|---|
| DE | 3512306 | A1 | * | 10/1986 |
| DE | 3636592 | A1 | * | 5/1988 |
| EP | 79826 | A1 | * | 5/1983 |
| GB | 2040672 | A | * | 9/1980 |

* cited by examiner

*Primary Examiner* — Darnell M Jayne
*Assistant Examiner* — Patrick Hawn
(74) *Attorney, Agent, or Firm* — Wegman, Hessler & Vanderburg

(57) ABSTRACT

A modular shelving system comprises multiple panels, multiple connection bars and multiple connectors. Each panel has multiple mortises. Each connection bar is connected to at least two panels and has multiple housing channels having slots. The connectors are respectively mounted in the housing channels of the connection bars and have four shoulders and multiple arms. The shoulders are formed at right angles to each other and one shoulder is mounted in a corresponding slot. The arms are formed on, protrude from the shoulders and respectively extend into corresponding mortises of the panels and two, three or four arms may be implemented. The modular shelving system can be conveniently assembled and disassembled in various combinations for different spaces while maintaining design consistency.

16 Claims, 8 Drawing Sheets

MODULAR SHELVING SYSTEM

BACKGROUND OF THE INVENTION

1. Field of the Invention

The present invention relates to modular shelves, especially to a modular shelving system that can be conveniently assembled and disassembled in various combinations for economizing space and material usage while maintaining design consistency.

2. Description of the Related Art

A conventional shelf unit comprises at least two side panels and multiple partitions forming chambers and may be ready to assemble (RTA). The partitions, especially RTA shelf units, may be adjustably mounted up and down the side panels. However, since the side panels are rigid, the shelf unit is inflexible in shape. When moving house or redecorating, the conventional shelf unit may not fit available space of the new house or new layout so must be thrown away. Furthermore, to increase storage space, multiple shelf units must be placed side by side; should extra height be required, a shelf unit may be placed atop another shelf unit, but this is unstable and dangerous. Furthermore, when two adjacent shelf units are placed side by side, the side panels form a thick partition wasting available space, material and reducing design consistency. Furthermore, conventional RTA shelf units may not be disassembled easily since screws, nails or permanent connectors may be implemented in assembly, which are hard to remove, or may damage the shelf units during disassembly.

To overcome the shortcomings, the present invention provides a modular shelving system to mitigate or obviate the aforementioned problems.

SUMMARY OF THE INVENTION

The main objective of the invention is to provide a modular shelving system that can be conveniently assembled and disassembled in various combinations for economizing space and material usage while maintaining design consistency.

The modular shelving system comprises multiple panels, multiple connection bars and multiple connectors. Each panel has multiple mortises. Each connection bar is connected to at least two panels and has multiple housing channels having slots. The connectors are respectively mounted in the housing channels of the connection bars and have four shoulders and multiple arms. The shoulders are formed at right angles to each other and one shoulder is mounted in a corresponding slot. The arms are formed on, protrude from the shoulders and respectively extend into corresponding mortises of the panels and two, three or four arms may be implemented.

The modular shelving system is easy to assemble since it uses insertion without screws or nails. Therefore the modular shelving system is easy to assemble and disassemble.

The modular shelving system is low cost. The number of panels, connection bars and connectors to buy and assemble is decided and a desired shelf unit assembled without surplus. Furthermore, unlike two conventional cabinets being stacked or placed side by side and having redundant thickness due to two abutting boards, only one panel is disposed between two chambers of the modular shelving system; thereby saving space and maintaining design continuity. Furthermore, after an original purchase, more panels and connection bars can be purchased and added, allowing the shelf unit to grow with needs and as finances allow, without requiring large initial investment or foregoing a shelf unit.

The modular shelving system may be implemented in various combinations. The modular shelving system can be assembled in various combinations by using different numbers of panels, connection bars and different kinds of connectors to fit different available spaces. Furthermore, the panels of the modular shelving system may have different patterns or colors; thereby providing various appearances.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
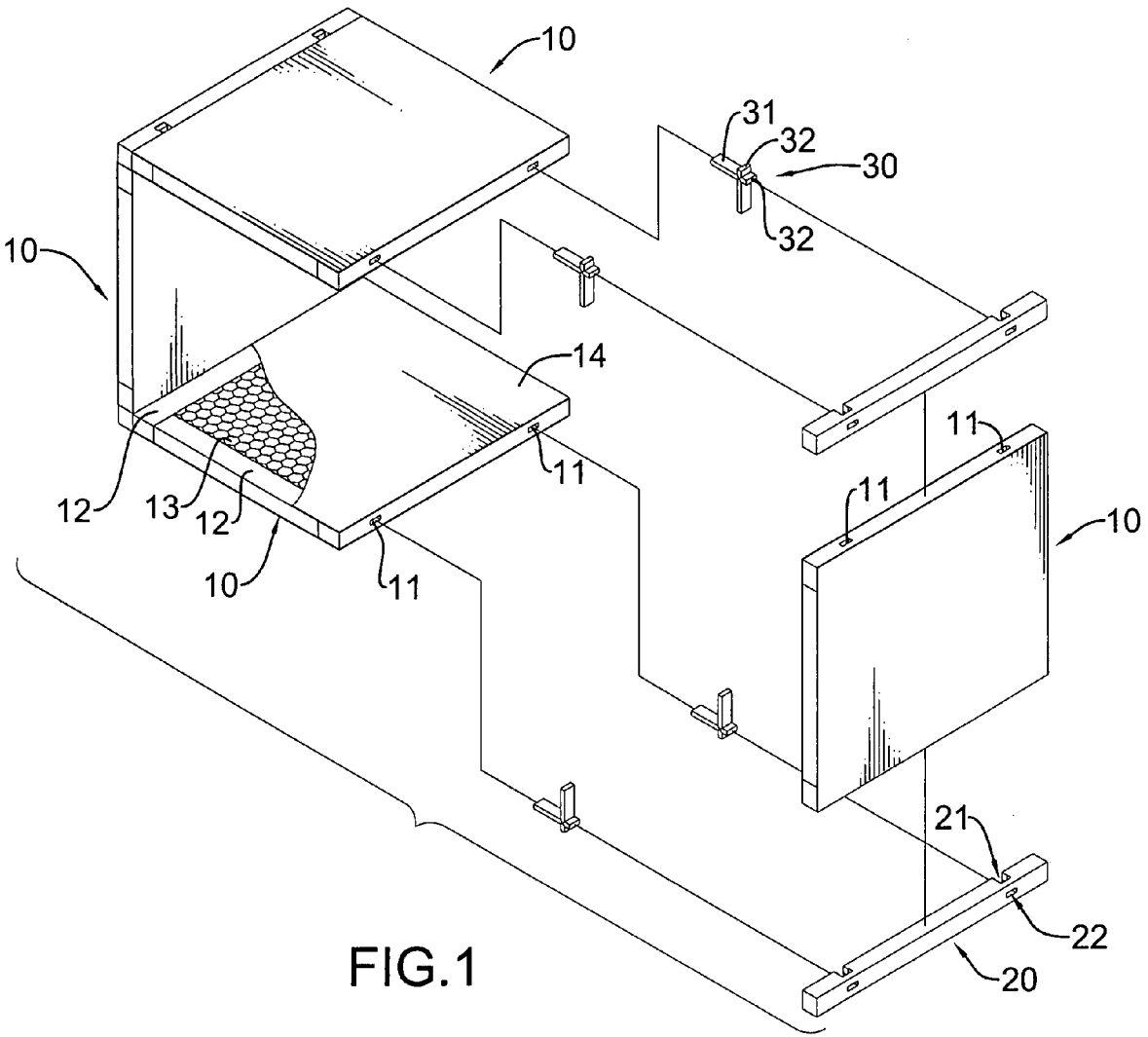
FIG. 1 is a partially exploded perspective view of a modular shelving system in accordance with the present invention.
Figure 8:
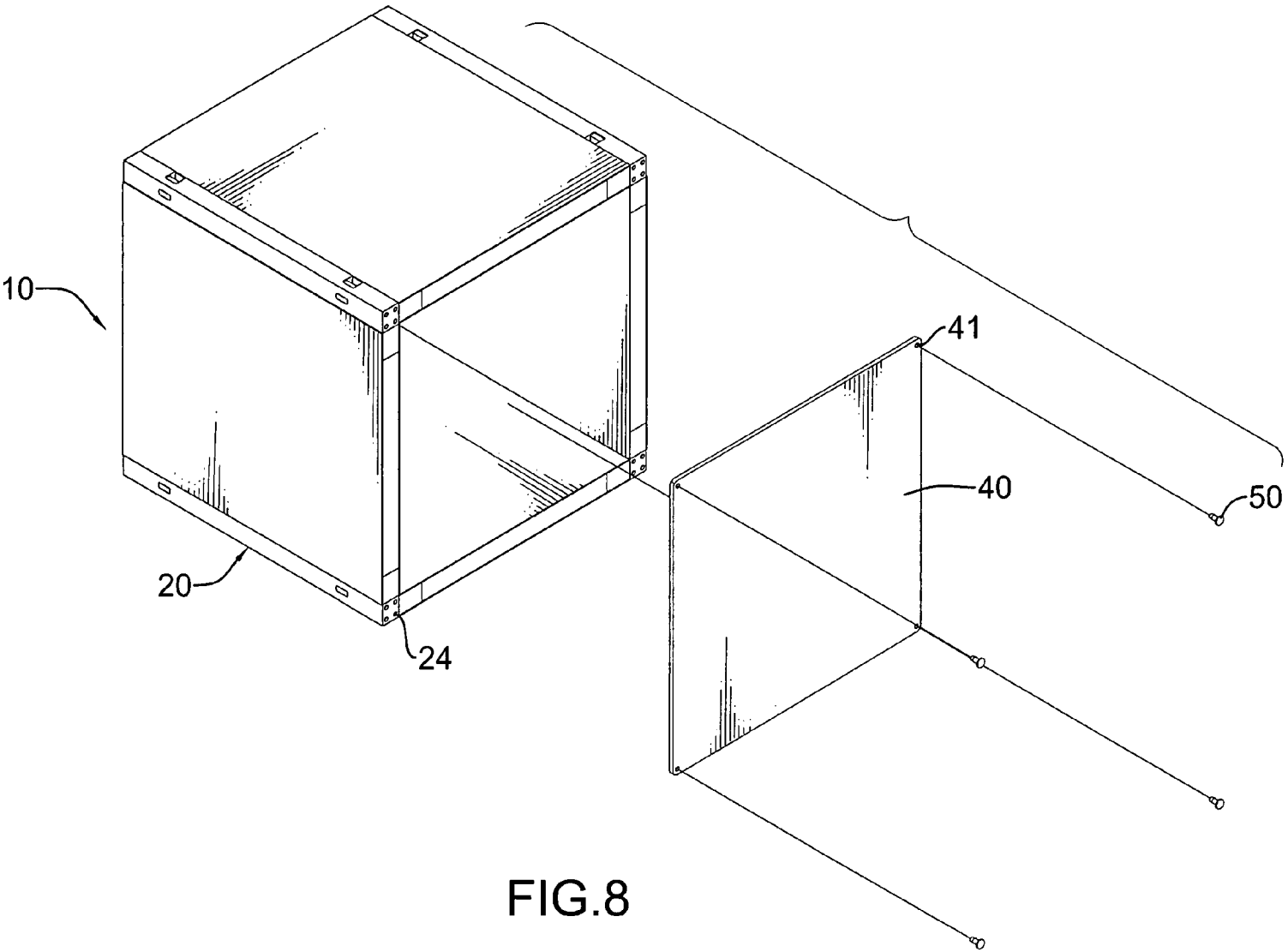
FIG. 8 is a partially exploded perspective view of the modular shelving system in FIG. 1 further implemented with a backboard.

With reference to FIGS. 1 and 8, a modular shelving system in accordance with the present invention comprises a panel assembly, multiple connection bars (20), multiple connectors (30) and may have at least one backboard (40).

Figure 2:
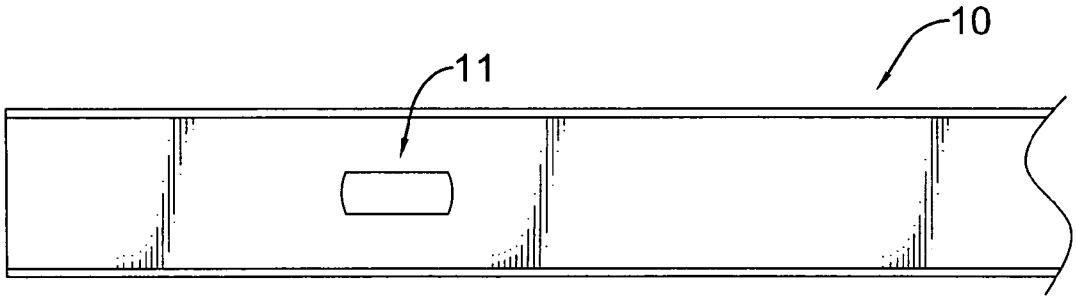
FIG. 2 is an enlarged side view of a panel of the modular shelving system in FIG. 1.
Figure 3A:
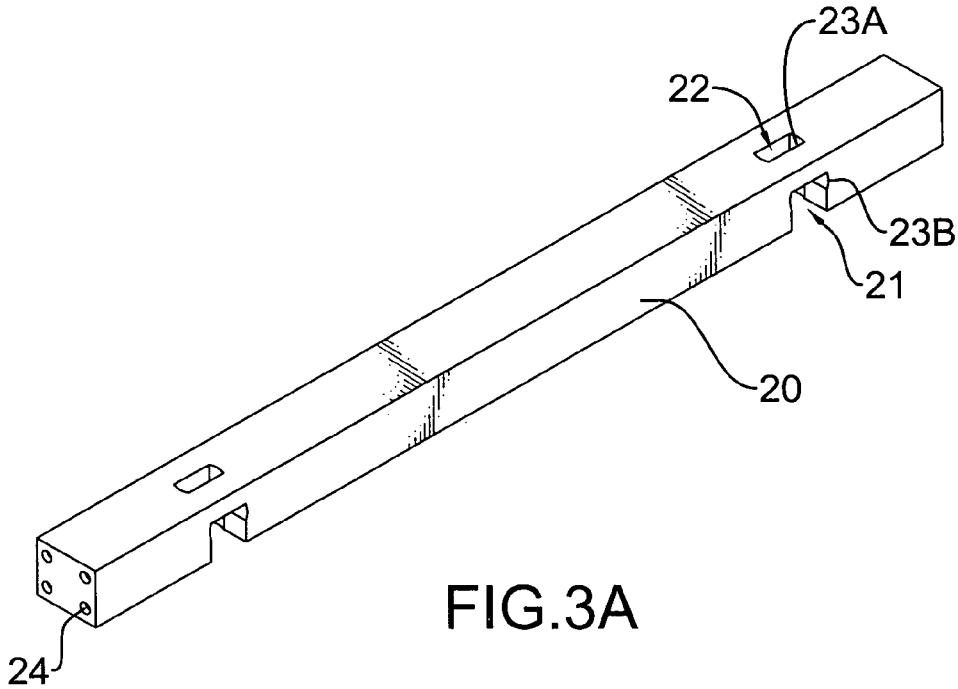
FIG. 3A is a perspective view of a connection bar of the modular shelving system in FIG. 1.
Figure 3B:
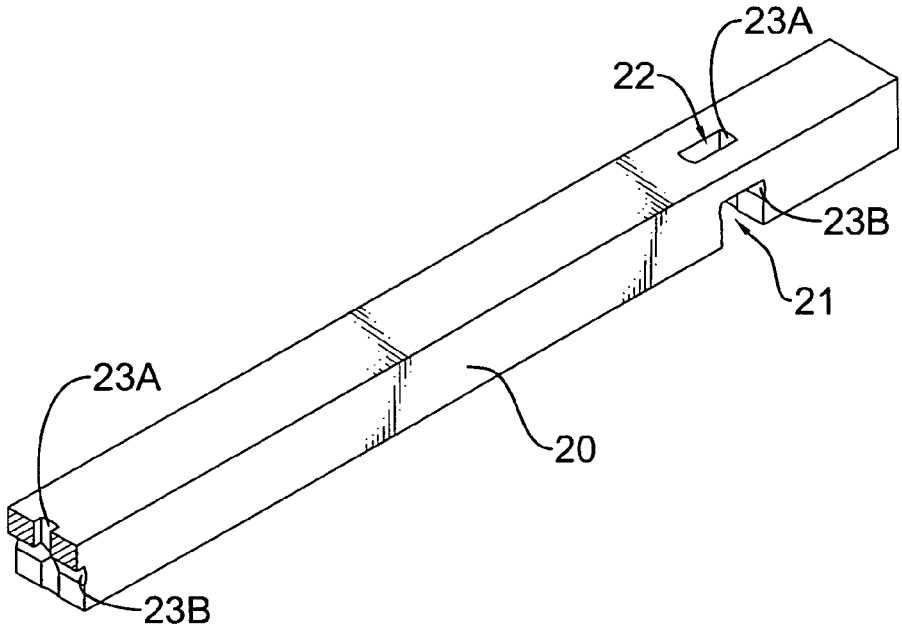
FIG. 3B is a perspective view in partial cross section of a connection bar of the modular shelving system in FIG. 3A.
Figure 3C:
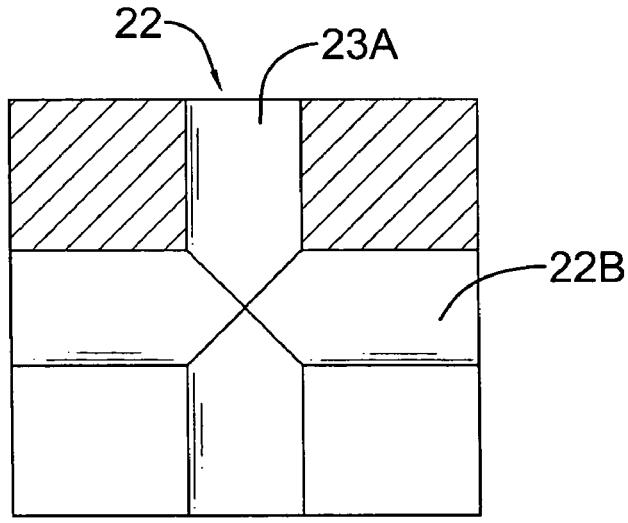
FIG. 3C is a side view in cross section of a connection bar of the modular shelving system in FIG. 3B.
Figure 4:
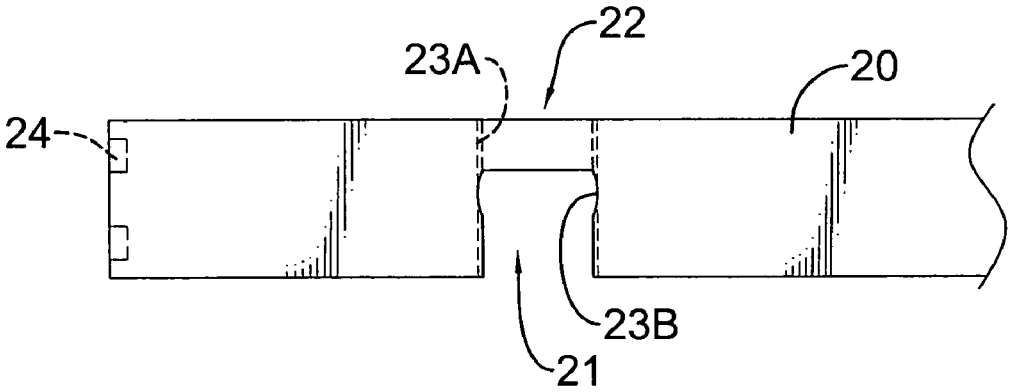
FIG. 4 is an enlarged side view if the connection bar in FIG. 3A.

The panel assembly has multiple panels (10), at least one chamber and at least one quadrangular open end. Each panel (10) has two sides being opposite to each other, at least one optional cover (14) and multiple mortises (11) and may be solid, or hollow. The at least one cover (14) of each panel (10) may be patterned, pellucid, or colored for enhanced appearance and may be pasteboard. When the panel (10) is hollow, the panel (10) has a frame (12) having at least two sidebars being opposite to each other and covered by the at least one cover (14) and have an optional infill layer (13). The infill layer (13) is formed in the frame (12) and may be sheets of paper or corrugated paper in honeycombed arrangement to reduce material cost and weight of the panel (10). With further reference to FIG. 2, the mortises (11) are formed in the sides of the panel (10) and may be formed in the at least two sidebars (12) of the frame. The at least one chamber is formed between the panels (10). The at least one quadrangular open end communicates with the at least one chamber.

With further reference to FIGS. 3A, 3B, 3C and 4, each connection bar (20) has an inner surface, an outer surface, two side surfaces and multiple housing channels (21) and may have at least one end and at least one mounting hole (24). The outer surface is opposite to the inner surface. The side surfaces of the connection bar (20) are opposite to each other and adjacent to the inner surface and the outer surface. The housing channels (21) are formed in the inner surface and through the side surfaces of the connection bar (20) and each housing channel (21) has a slot (22) and an inner surface and may have two opposite dents (23B) and two opposite grooves (23A). The slot (22) is formed through the inner surface of the housing channel (21) and the outer surface of the connection bar (20) and may be keyed. The dents (23B) of the housing channel (21) are concave and formed adjacent to the inner surface of the housing channel (21). The grooves (23A) are concave and perpendicular to the inner surface of the housing channel (21). The at least one mounting hole (24) is formed in the least one end of the connection bar (20).

Figure 5:
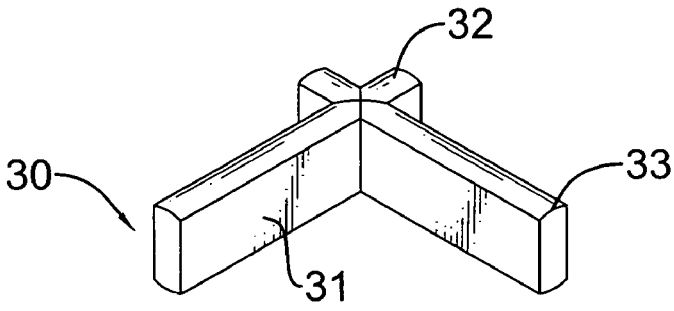
FIG. 5 is a perspective view of a first embodiment of a connector of the modular shelving system.
Figure 6:
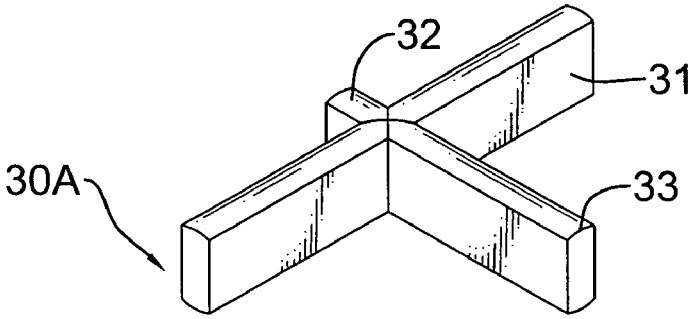
FIG. 6 is a perspective view of a second embodiment of the connector of the modular shelving system.
Figure 7:
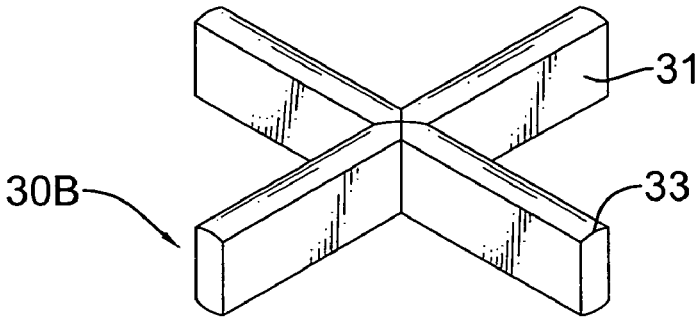
FIG. 7 is a perspective view of a third embodiment of the connector of the modular shelving system.

With further reference to FIGS. 5, 6 and 7, the connectors (30) are respectively mounted in the housing channels (21) of the connection bars (20) and each connector (30, 30A, 30B) is cross-shaped and has a junction and multiple arms (31). Each junction is mounted in a corresponding housing channel (21) and comprises four shoulders (32) being formed at right angles to each other. Each shoulder (32) may have two opposite side surfaces being keyed, may be convex, to correspond to and be securely mounted in the dents (23B) and the slot (22). One shoulder (32) of each junction is secured in the slot (22) of a corresponding housing channel (21). The arms (31) are formed on and protrude from the shoulders (32), respectively extending into corresponding mortises (11) of the panels (10) and may have two opposite side surfaces (33). The side surfaces (33) of the arms (31) extend from the side surfaces of the shoulder (32) and correspond to the dents (23B) and the slot (22), and may be convex. Each mortise (11) of the panels (10) corresponds to each arm (31) of the connectors (30). The connectors (30) may be implemented as different types depending on assembly requirements. Therefore the connectors (30) may have two arms (31) formed at right angles or parallelly, three arms (31) or four arms (31).

Figure 9:
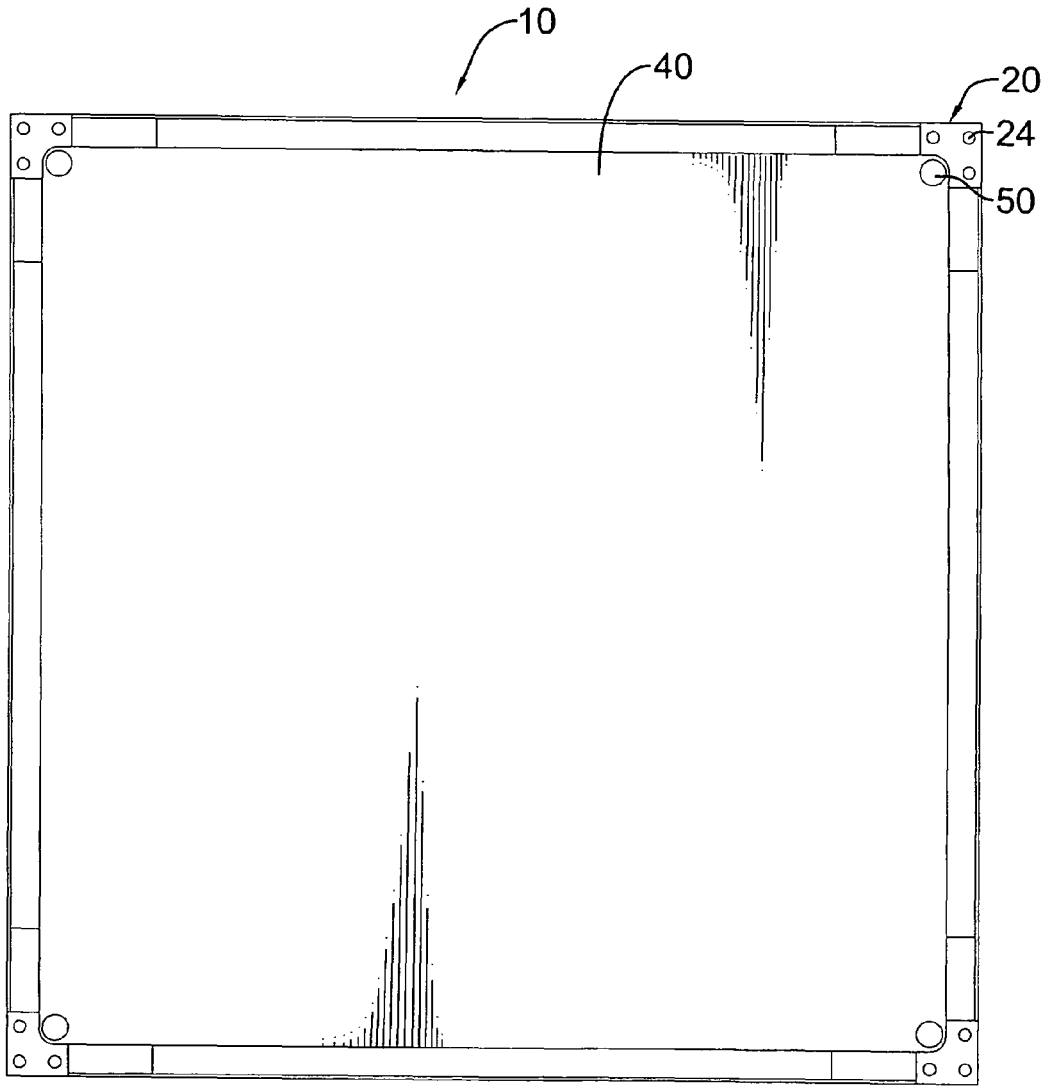
FIG. 9 is a rear view of the modular shelving system in FIG. 8.

With further reference to FIG. 9, the at least one backboard (40) covers the at least one quadrangular open end of the parallelepiped formed by the panels (10) and the at least one backboard (40) has multiple through holes (41) and multiple fasteners (50). The through holes (41) are formed through the at least one backboard (40), are respectively disposed at four corners of the backboard (40) and align with the mounting holes (24) of the connection bars (20).

The fasteners (50) are respectively mounted through the through holes (41) of the at least one backboard (40) and the mounting holes (24) of the connection bars (20) to attach the backboard (40) on the at least one quadrangular open end and may be resilient rivets, pins, screws, nails or the like.

Figure 10:
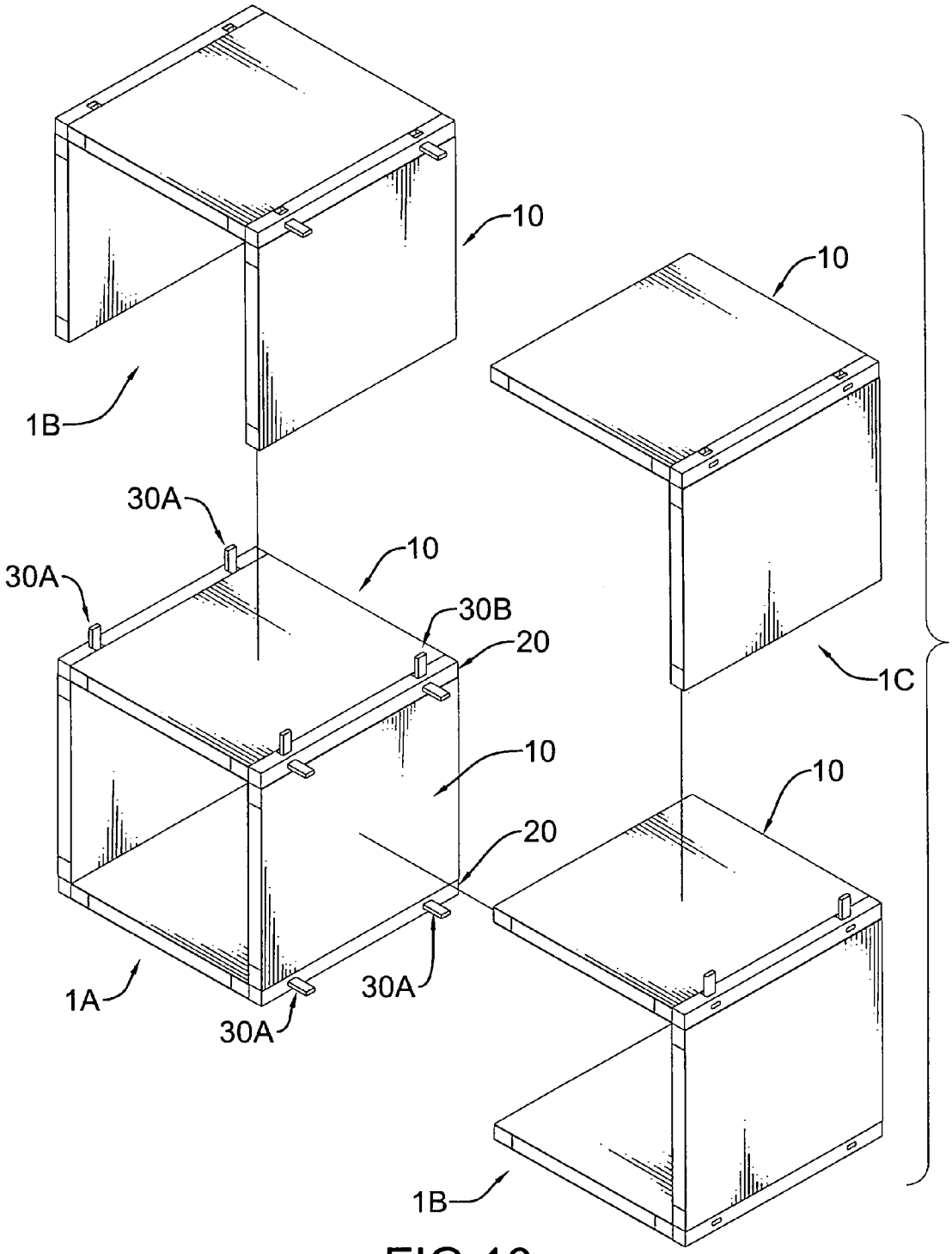
FIG. 10 is a partially exploded perspective view of the modular shelving system in FIG. 1, shown with extension units and a corner unit.

With further reference to FIG. 10, the modular shelving system may comprise a base unit (1A) and may further have at least one extension unit (1B) and at least one corner unit (1C). The base unit (1A) has four panels (10), four connection bars (20), multiple connectors (30) and an optional backboard (40). The extension unit (1B) has three panels (10), two connection bars (20), multiple connectors (30) and an optional backboard (40). The corner unit (1C) has two panels (10), one connection bar (20), multiple connectors (30) and an optional backboard (40).

Therefore, the base unit (1A) can be bought and built by placing required connectors (30) into the connection bars (20) and sliding panels (10) onto the arms (31) of the connectors (30). Should a change or mistake be made, an implement can be used to push the shoulder (32) through the slot (22) to release the detent (23B), alternatively the panel (10) can be pulled to release the panel (10). Extension units (1B) may then be purchased and added as required. To form different designs, the extension units (1B) may be added above, below or adjacent to the base unit. Also, corner units (1C) may be bought and added when required or to achieve different designs.

The modular shelving system can be conveniently assembled in various combinations by using different numbers of panels (10) and different kinds of connectors (30, 30A, 30B) to fit different living spaces. Furthermore, unlike two conventional cabinets being stacked or placed side by side, only one panel (10) is disposed between two chambers of the modular shelving system thereby saving space and maintaining consistency of design.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A modular shelving system comprising:

a panel assembly having multiple panels, each panel having two sides being opposite to each other; and multiple mortises being formed in the sides of the panel;

at least one chamber be formed between the panels; and at least one quadrangular open end communicating with the at least one chamber;

multiple connection bars, each connection bar being connected to at least two panels and having an axial direction;

an inner surface;

an outer surface being opposite to the inner surface;

two side surfaces being opposite to each other and adjacent to the inner surface and the outer surface; and multiple housing channels being formed in the inner surface and through the side surfaces and each housing channel extending along a direction perpendicular to the axial direction and having a slot being formed through an inner surface of the housing channel and the outer surface of the connection bar; and multiple connectors being respectively mounted in the housing channels of the connection bars and each connector being cross-shaped and having a junction being mounted in a corresponding housing channel and comprising four shoulders being formed at right angles to each other, wherein one shoulder of the junction is secured in the slot of the corresponding housing channel; and multiple arms being integrally and inseparably formed on and protruding from the shoulders and respectively extending into corresponding mortises of the panels.

2. The modular shelving system as claimed in claim 1, wherein each connection bar further has at least one end; and at least one mounting hole being formed in the at least one end of the connection bar; and the modular shelving system further has at least one backboard covering at least one quadrangular open end and the at least one backboard has multiple through holes being formed through the backboard, being respectively disposed at four corners of the backboard and aligning with the mounting holes of the connection bars; and multiple fasteners being respectively mounted through the through holes of the at least one backboard and the mounting holes of the connection bars.

3. The modular shelving system as claimed in claim 1, wherein at least one of the connectors has two arms being formed at right angles to each other.

4. The modular shelving system as claimed in claim 1, wherein at least one of the connectors has three arms.

5. The modular shelving system as claimed in claim 1, wherein at least one of the connectors has four arms.

6. The modular shelving system as claimed in claim 1, wherein each housing channel of the connection bars has two opposite dents being concave and formed adjacent to the inner surface of the housing channel;

each shoulder of the junction has two opposite side surfaces being convex and corresponds to the dents and the slot;

the arms have two opposite side surfaces extending from the side surfaces of the shoulder, corresponding to the dents and the slot and being convex; and each mortise of the panels corresponds to each arm of the connectors.

7. The modular shelving system as claimed in claim 1, wherein each panel is hollow and further has a frame having at least two sidebars being opposite to each other; and at least one cover covering the frame; and the mortises of the panel are formed in the at least two sidebars of the frame.

8. The modular shelving system as claimed in claim 7, wherein each panel further has an infill layer disposed between the at least two sidebars of the frame.

9. The modular shelving system as claimed in claim 8, wherein the infill layer is corrugated paper in honeycombed arrangement; and the at least one cover is pasteboard.

10. The modular shelving system as claimed in claim 9, wherein the at least one cover of each panel is patterned, pellucid or colored.

11. The modular shelving system as claimed in claim 2, wherein at least one of the connectors has two arms being formed at right angles to each other;

at least one of the other connectors has three arms; and at least one of the rest of connectors has four arms.

12. The modular shelving system as claimed in claim 11, wherein each panel is hollow and further has a frame having at least two sidebars being opposite to each other; and at least one cover covering the frame; and the mortises of the panel are formed in the at least two sidebars of the frame.

13. The modular shelving system as claimed in claim 12, wherein each panel further has an infill layer disposed between the at least two sidebars of the frame.

14. The modular shelving system as claimed in claim 13, wherein the infill layer is corrugated paper in honeycombed arrangement; and the at least one cover is pasteboard.

15. The modular shelving system as claimed in claim 14, wherein the at least one cover of each panel is patterned, pellucid or colored.

16. The modular shelving system as claimed in claim 15, wherein each housing channel of the connection bars has two opposite dents being concave and formed adjacent to the inner surface of the housing channel;

each shoulder of the junction has two opposite side surfaces being convex and corresponds to the dents and the slot;

the arms have two opposite side surfaces extending from the side surfaces of the shoulder, corresponding to the dents and the slot and being convex; and each mortise of the panels corresponds to each arm of the connectors.

* * * * *